US005632069A

United States Patent [19]

Mievis

[11] Patent Number: 5,632,069

[45] Date of Patent: May 27, 1997

[54] GARMENT SUPPORT DEVICE

[76] Inventor: William J. Mievis, Rue Paul Janson 26, 1020 Brussels, Belgium

[21] Appl. No.: 347,339

[22] PCT Filed: Jun. 2, 1993

[86] PCT No.: PCT/BE93/00031

§ 371 Date: Feb. 28, 1995

§ 102(e) Date: Feb. 28, 1995

[87] PCT Pub. No.: WO93/25104

PCT Pub. Date: Dec. 23, 1993

[30] Foreign Application Priority Data

Jun. 5, 1992 [BE] Belgium ..... 09200525

[51] Int. Cl.[6] ..... A44B 1/04

[52] U.S. Cl. ..... 24/337; 24/333; 24/504; 24/541

[58] Field of Search ..... 24/328, 333, 329, 24/337, 504, 506, 516, 541; 2/336, 340, 341

[56] References Cited

U.S. PATENT DOCUMENTS

| | | | |
|---|---|---|---|
| 586,666 | 7/1897 | Neuendorff | 24/333 X |
| 2,136,802 | 11/1938 | Moser | 24/337 |
| 2,585,181 | 2/1952 | Stavropoulos et al. | 24/328 X |
| 4,056,139 | 11/1977 | Murt | 24/329 X |
| 4,675,953 | 6/1987 | Higgs | 24/499 |

FOREIGN PATENT DOCUMENTS

| | | | |
|---|---|---|---|
| 674622 | 11/1963 | Canada | 24/504 |
| 3938 | 4/1905 | France | 24/541 |
| 17288 | 1/1897 | United Kingdom | 24/541 |

*Primary Examiner*—Peter M. Cuomo
*Assistant Examiner*—Hanh V. Tran
*Attorney, Agent, or Firm*—Bacon & Thomas

[57] ABSTRACT

A device for holding up trousers (1), skirts, short or similar by attaching this item of clothing to a second item of clothing such as a shirt (2), blouse, top or similar includes a rigid base piece (3) less than fifteen centimeters in length and having a clip (4) at one end, one leg of said clip being secured to or integral with the base piece (3). The rigid base piece (3) is provided with an attachment device (5) at its end opposite the clip (4), the mobile leg (6) of said clip (4) being oriented, when the clip (4) is closed, towards the above-mentioned end fitted with the attachment device (5) in such a way that, when the clip (4) is attached to the edge (12) of the first item of clothing (1), the attachment device (5) at the opposite end can be positioned inside the first item of clothing (1), the attachment device (5) being designed for attachment to the second item of clothing (2) lying inside the first item.

6 Claims, 3 Drawing Sheets

GARMENT SUPPORT DEVICE

BACKGROUND OF THE INVENTION

The invention concerns a garment support device to keep a first lower body covering garment such as trousers, a skirt, shorts or the like in place by affixing this first garment to a second upper body covering garment such as a shirt, blouse or the like, said device comprising an elongate rigid sheet-like base or basic element less than 15 cm. long and fitted at one end with a fastener designed to be affixed to a section of the second garment located in the first garment.

RELATED ART

Such devices are used to replace braces. Braces keep up trousers very well and therefore are often preferred to belts, especially by persons who move a lot or who are stout. However, braces are not aesthetic.

Such a device is already known from the French patent document A2,357,195. This device comprises a base or basic element consisting of a clip leg and an extension of said leg. The fastener is a dip movably attached to a shirt or the like. The shirt extension engages or hooks onto a strap or a pocket present below the upper belt rim of the trousers and inside said belt.

In order to be able to use the known device, straps or pockets must be provided, in other words the trousers must be specially made.

The invention aims to remedy these disadvantages and to provide a device to keep trousers, a skirt, shorts or the like in place, which keeps the garment efficiently up without it having to be provided with straps or pockets, whereby the device can be worn such that only a part of the device is visible, a part which may be very inconspicuous or on the contrary well visible but which looks very nice or aesthetic.

For that purpose the rigid base or basic element is fired at its end opposite the fastener with a clip designed to be affixed to the waistband of the first garment, one leg of this clip being rigidly joined to or integral with the base element, the other movable leg of the dip pointing in the direction of the end of the basic element bearing the fastener when the dip is dosed in such a way that when the dip is affixed to the waist band of the first garment, the fastener on the opposite end can be located inside the first garment and be affixed to a section of the second garment located inside the first garment.

U.S. Pat. No. 1,958,643 describes a device with a rigid basic element comprising at one end a first clip of which one let is rigidly joined to the basic element and at the other end a second clip. However, the movable leg of the first clip points outward, in other words, when this clip is affixed to the rim of trousers, the device shall be outside them and be visible almost entirely. The other dip is affixed in pivoting manner to the basic element and comprises two legs perpendicular to the longitudinal direction of said basic element. This dip is used for affixation to the front rim of a shirt above the trousers.

The German patent document no. U.S. Pat. No. 8,509,839 also discloses a device with a rigid basic element comprising a clip at both ends, one leg of these clips being an integral part of the basic element. The mobile legs of these clips are directed in the opposite sense. When a clip is attached on the waistband of a pair of trousers, said device is consequently situated outside the trousers and is thus visible. In fact, this device is an improved embodiment of a clip for braces, as the device is used to be attached to a brace belt by means of one of its clips. Moreover, the basic element is provided with slits to insert this belt in.

According to a special embodiment of the invention, the fastening means is also a clip.

Practically, one of the legs of the clip forming the fastening means is solid with or forms an integral part of the rigid basic element.

The legs of the two clips are then preferably directed in one and the same sense in closed position.

The mobile legs of the two clips are preferably situated on one and the same side of the rigid element.

The top clip which serves to be clipped on the waistband of the trousers, skirt, shorts or the like can be larger than the other clip which serves to be clipped on the other garment inside the latter.

BRIEF DESCRIPTION OF THE DRAWINGS

For clarity's sake, an embodiment of a garment support device according to the invention for keeping in place a pair of trousers, a skirt, shorts or the like is described hereafter as an example only without being limitative in any way, with reference to the accompanying drawings where.

DETAILED DESCRIPTION OF THE PREFERRED EMBODIMENTS

Figure 1:
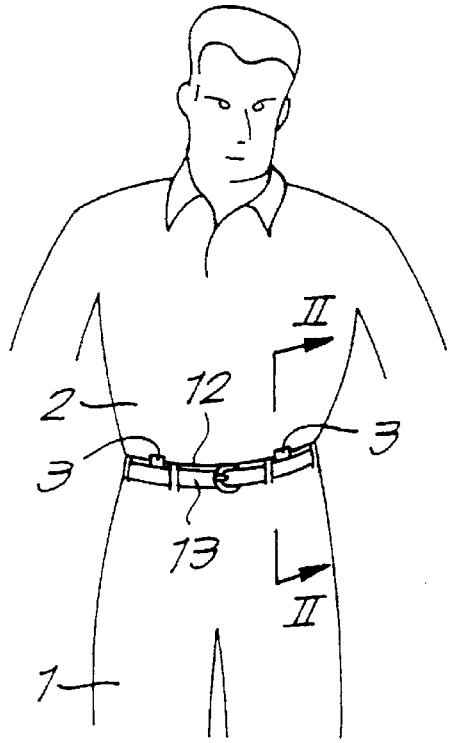
FIG. 1 shows a man wearing trousers kept up by a device according to the invention.

FIG. 1 shows a man wearing trousers 1 and a shirt 2, whose trousers 1 are kept up in the front by means of two devices according to the invention, one above each leg.

Figure 2:
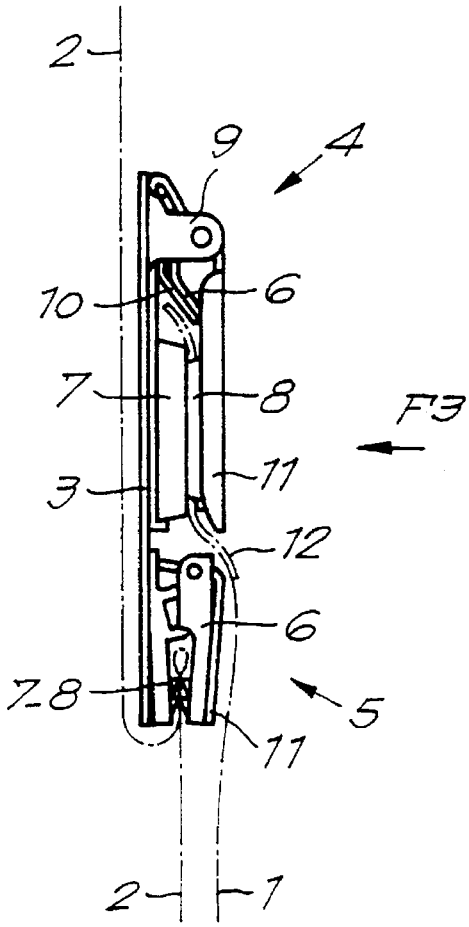
FIG. 2 shows a section according to line II—II from FIG. 1 to a larger scale.
Figure 3:
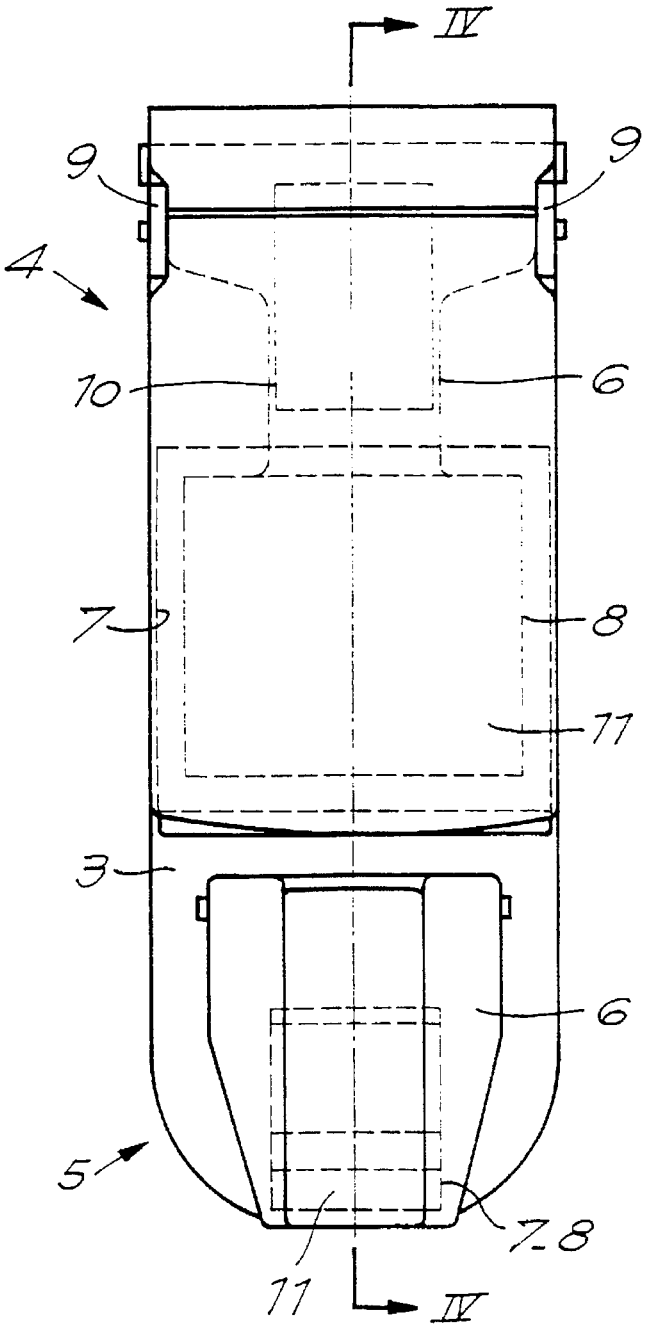
FIG. 3 shows a view of the device according to the arrow F3 from FIG. 2 at yet a larger scale.
Figure 4:
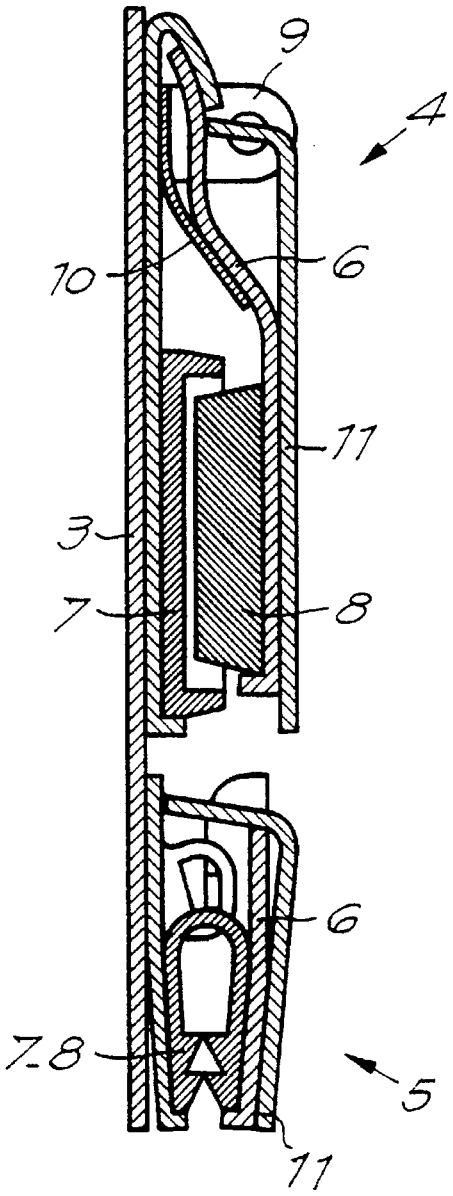
FIG. 4 shows a section according to line IV—IV from FIG. 3.

As represented in detail in FIGS. 2 to 4, each device consists of a rigid base or basic plate or element 3 made of metal and two jaws, pins or clips 4 and 5, one at each end.

The length of the rigid basic element 3 is shorter than fifteen centimeters and is normally 5 to 6 cm for children, 6 to 10 cm, for example about 7 cm, for men, and 6 to 14 cm, for example 10 cm, for women. The width is smaller than 6 cm and normally 2 to 3 cm, except at the lower end where the width decreases.

The clips 4 and 5 are made in a similar and known way; they are for example of the type used to fasten the known braces to a pair of trousers, with this difference that one of the legs 6 or sides of each jaw or clip is rigidly secured to or solid with an end of the basic element 3, i.e. it is fastened, for example glued to it.

Each clip has an antiskid part 7 or 8 inside its legs 6, for example made of plastic or rubber.

In the top clip 4, which has practically the same width as the element 3, these parts 7 and 8 are separate but complementary parts. The part 7 is directly attached to the element 3 and forms a square toothed cup 7 in which the part 8 which is attached to the mobile or pivoting side or leg 6 can penetrate, a part which is also square-shaped but which is smaller. Said pivoting leg 6 is hinge-mounted between supports 9 mounted on the element 3. A leaf spring 10, fixed between the supports 9 to the element 3, pushes back the pivoting leg or side 6 and thus pushes the clip in its open position. This clip can be closed and maintained in its closed position by means of a lever 11 which is hinge-mounted between the supports 9 around a shaft situated at a larger distance from the element 3 than the hinge shaft of the pivoting leg 6. The lever 11, which is bent in an L-shape, goes through a dead point when it swings towards the basic element 3 while closing the clip 4 or 5 such that, once it is closed, the clip is kept in this position by the lever as long as it is not swung back by hand.

In the bottom clip 5, which is smaller than the clip 4 and which narrows even towards its lower end, the parts 7 and 8 together form a single toothed strip folded in two. This strip is made of rubber and produces a spring effect which tends to put the clip in its open position. Thus, said clip 5 does not have a separate spring 10. The clip 5 also contains, in a similar manner as the clip 4, a control lever 11 to close the clip 5 and keep it closed.

In the embodiment represented in the FIGS. 1 to 4, the legs 6 of the two clips 4 and 5 are, when the clips are closed, directed in the same sense, i.e. downward. That is, the legs are openable and closable while facing the same direction along the basic element. Also, as in the drawings, the clips 4 and 5 do not overlie each other on the basic element but are longitudinally spaced thereon. Moreover, these pivoting legs or sides 6 of the clips 4 and 5 are situated on one and the same side, called front side, of the basic element 3.

To put the device in place, it is slipped inside the trousers, between the latter and the shirt 2, with the clip 4 at the top. The clip 4 is clipped on the waistband 12 of the trousers 1 with one outer pivoting leg 6 on the outside, whereas the clip 5, which is placed just underneath the waistband 12 of the trousers, is clipped on the part of the shirt 2 inside the trousers, as represented in FIG. 2, where the trousers 1 and the shirt 2 are represented by means of a broken line. Normally, two devices will be used on the front, at the height of the groins.

Once it has been put in place, the device fits the inside of the waistband 12 of the trousers and the only thing that remains visible of the device is the lever 11 and the top part of the top clip 4. If necessary, the lever may even be covered to a large extent by a belt 13 which is put around the waist 12 of the trousers 1 but which, contrary to belts of this type, does not serve to retain the trousers in place but only serves as an embellishment.

In certain cases the lever 11 is not covered, but made hardly noticeable thanks to its colour which may be very similar to that of the trousers. In other cases, however, the lever may catch the eye with its form, its colour, a design or an inscription.

Figure 5:
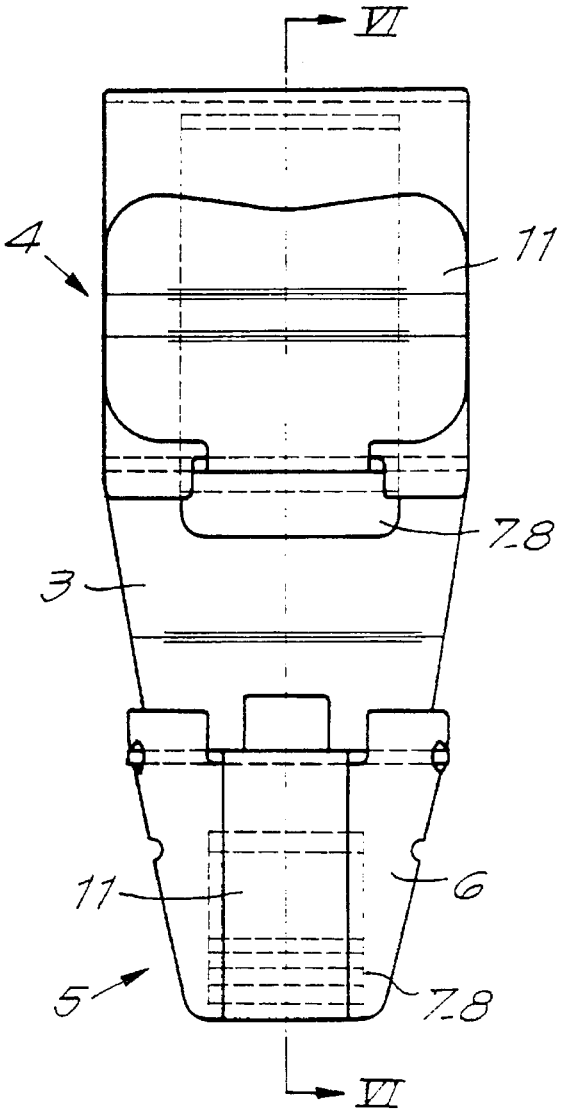
FIG.5 shows a front view analogous to that in FIG. 4 of a device according to the invention, but concerning another embodiment.
Figure 6:
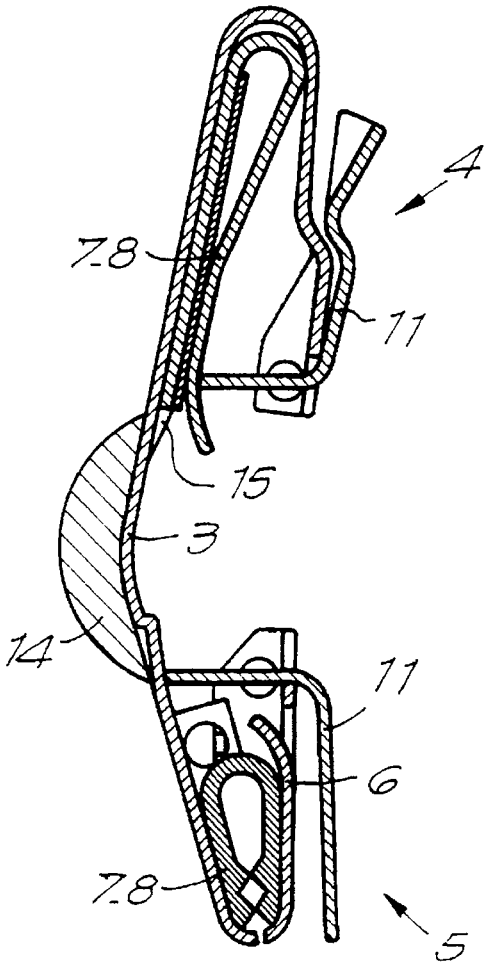
FIG. 6 shows a section according to line VI—VI from FIG. 5.

The embodiment of the device according to the FIGS. 5 and 6 mainly differs from the above-described embodiment by the form or the design of the clips 4 and 5 and in that the rigid basic element 3 is not flat but slightly bent or curved so as to present a hollow or concave side, a cushion 14 made of synthetic foam being glued to the back or convex side, approximately in the middle. The clips 4 and 5 are situated in the front, on the hollow side of the basic element 3.

The bottom clip 5 in FIG. 6 is almost identical to the clip 5 of the device according to FIGS. 1 to 4, with this difference that one of the legs 6 which is rigidly secured to with the basic element 3 is not fixed to this element but forms an integral part with it.

The top clip 4, however, has another design. Instead of being composed of two rigid legs connected to one another in a pivoting manner, the clip 4 consists of a spring leaf bent in the shape of a hair pin, whereby the two legs hold a free position, with their ends apart. A lever 11, hinge-mounted on a part which is bent towards the front of the basic element 3 makes it possible to surmount the spring action and to put the clip in its closed position, as represented in FIGS. 5 and 6. As the clip 4 is a spring itself, a supplementary spring 10 is not required. The leg of the clip 4 which is rigidly secured to the basic element 3 is held on this element since it is caught between two bosses 15 on the one hand and the bent end of the basic element 3 on the other hand. Only this leg is covered on the inside of the clip 4 with a rubber coating 7.

The device is applied in an entirely similar manner as the device according to FIGS. 1 to 4. The curve of the basic element 3 has for a result that, once the clip 4 is attached to the waistband 12 of the trousers 1, the bottom end of this element 3, which is situated inside the trousers 1 is moved slightly away from the body of the person. The cushion 14 ensures a softer contact with the device.

Two devices as described above placed in front are sufficient to keep up the trousers 1 in an efficient and aesthetic way. Since these devices keep up the trousers 1 in relation to the shirt 2, they also prevent the shirt from coming out of the trousers 1.

Such devices can also keep up skirts in a similar manner. Two devices are attached to the waistband of the skirt by means of their top clip 4, whereby they fit the inside of this waistband, and to the part of the blouse or shirt blouse situated inside the skirt by means of their bottom clip 5. At the same time, these devices prevent the blouse or shirt blouse from coming out of the skirt.

The device can also be used to keep shorts in place. It is attached to the belt of the short by means of the clip 4 and to the shirt, blouse or sweater by means of the clip 5.

The above-described device can efficiently replace a belt or braces. Its design is simple and economical. The trousers, skirt or shorts to be kept up always remain perfectly in place, despite intense movements. The garment which is put in the trousers, skirt or short and to which the device or devices are attached in this case serves as a pair of braces. One or two devices are sufficient to be impeccably dressed under all circumstances. The device can be used by men as well as women and children, by slim as well as fat persons. If one wishes to take off the trousers or skirt, one must not take off the outer garments, as is the case with ordinary braces. One only has to open one of the clips or both the clips of the devices.

Because the clips 4 and 5 are situated on the same side as the rigid element 3, the fixing of the clip 5 to the shirt, blouse or sweater is made easier. It is even possible to open the bottom clip 5 and thus to take out the shirt 2 or the like from outside, i.e. through the trousers or the like.

It is clear that numerous modifications can be made to the above-described examples while still remaining within the scope of the invention as described in the following claims.

In particular, the clips may have another design. They must not necessarily contain a spring and a control lever. Without such a lever, it is the free leg of the top clip which remains visible outside the garment to be kept up.

The rigid element should not be necessarily made of metal. It can be made of plastic or another material. It is essential, however, that it keeps the clips or other fastening means at a certain distance from one another.

It is not absolutely necessary that one of the legs of each clip forms an integral part of the rigid element. This leg can also be made solid with the rigid element by any means whatsoever, and it can for example be glued with its back to the rigid element.

Neither is it essential that the mobile legs of the two clips, in closed position, are directed in the same sense. The pivoting leg of the bottom clip can also be directed upwards, for example when the other leg of this clip is solid with or forms an integral part of an end bent some 180 degrees in relation to the basic element.

The clips must not necessarily be situated on the same side as the basic element.

What is claimed is:

1. A garment support device for securing a first lower body covering garment to a second upper body covering garment normally worn by an individual at a higher position on the body than the first garment, the support device comprising:

an elongate rigid sheet-like base element having a length less than 15 cm;

a first fastener secured at one end area of the base element, said first fastener including a clamping jaw comprising opposed jaw sides movable towards and away from each other for closing and opening the jaw, said clamping jaw being openable in a longitudinal direction extending towards a first end of the base element so as to permit reception therein of an upper edge area of a first garment in an upward direction in use;

at least one side of the clamping jaw of said first fastener being rigidly associated with the base element; and a second fastener secured at the opposite end area of the base element and being located on the base element so as to not to overlie said first fastener, said second fastener being arranged to grip a second garment in use at a location along the base element longitudinally spaced from said first fastener and at a lower position on the base element from the first fastener when the support device is in use with the base element in a generally vertical position, whereby a lower section of an upper garment may be secured to the base element inside a lower garment by the second fastener while the lower garment is secured to the base element by the first fastener.

2. A garment support device as claimed in claim 1, wherein said second fastener includes a second clamping jaw having jaw sides movable towards and away from each other to open and close the second jaw, said second jaw also openable in the same direction as the first fastener clamping jaw so as to permit a portion of the second garment to be received in said second jaw in an upward direction in use.

3. A garment support device as claimed in claim 2, wherein one jaw side of said second clamping jaw is rigidly connected to said base element.

4. A garment support device as claimed in claim 1, wherein said base element is curved so as to present a concave side and wherein said first fastener is located on said concave side of the base element.

5. A garment support device as claimed in claim 1, wherein said second fastener is located on the same side of the base element as said first fastener.

6. A garment support device as claimed in claim 1, wherein said base element is made of metal.

* * * * *